United States Patent [19]

Bavaveas

[11] Patent Number: 5,067,638

[45] Date of Patent: Nov. 26, 1991

[54] DEVICE FOR DISPENSING MEASURES OF A GIVEN VOLUME OF A LIQUID CONTAINED IN A DEFORMABLE CONTAINER COMPRISING A SAFETY ELEMENT

[75] Inventor: Tristan Bavaveas, Paris, France

[73] Assignee: Societe dite: Eparco S.A., France

[21] Appl. No.: 387,020

[22] Filed: Jul. 28, 1989

[30] Foreign Application Priority Data

Jul. 29, 1988 [FR] France ..... 8810285

[51] Int. Cl.[5] ..... G01F 11/26

[52] U.S. Cl. ..... 222/205; 222/207; 222/212; 222/522

[58] Field of Search ..... 222/205, 207, 212–213, 222/457, 499, 514, 518, 523–525, 559, 153

[56] References Cited

U.S. PATENT DOCUMENTS

| | | | |
|---|---|---|---|
| 2,889,088 | 6/1959 | Gardner | 222/523 |
| 3,095,128 | 6/1963 | Wonso | 222/524 X |
| 3,120,910 | 2/1964 | Nyden | 222/525 |
| 3,252,634 | 5/1966 | Scholle | 222/514 |
| 3,294,294 | 12/1966 | Amburgey | 222/525 |
| 4,474,312 | 10/1984 | Donoghue | 222/205 |
| 4,625,897 | 12/1986 | Wortley | 222/205 |
| 4,702,473 | 10/1987 | Paquette | 222/212 X |

FOREIGN PATENT DOCUMENTS

| | | | |
|---|---|---|---|
| 2563190 | 10/1985 | France . | |
| 2572056 | 4/1986 | France . | |
| 1488355 | 10/1977 | United Kingdom | 222/205 |

*Primary Examiner*—Michael S. Huppert

*Attorney, Agent, or Firm*—Hill, Van Santen, Steadman & Simpson

[57] ABSTRACT

The device of the invention permits the dispensing of measures of a given volume of a liquid contained in a deformable container. It provides increased safety. It comprises in particular a one-piece displaceable safety element (5) comprising an upper gripping part (6) having a transverse closing face (7), a hollow central part forming a valve (8) and a lower part (9) forming a slide and outlet orifice, also hollow. This safety element thus comprising an axial hollow (10) is mounted so as to slide axially on the tube (1) via its lower part (9) between two limimt positions where it may be held. In the lowre closed position where the central part (8) of the safety element (5) is active, it then prevents the passage of liquid from the container to the cup via the tube (1) and its feed and outlet holes (3). In the upper open position, where this passage is made possible via axial and lateral holes (11) in the lower part (9) and and axial hollow (10) with which they communicate, the central part (8) is then inactive, the upper gripping part (6) of the safety element (5) projects permanently, at least partially, from the cup, the safety element (5) being such that, once the cap has been removed by the user, the latter must, in order to be able to use the device for dispensing measures, deliberately move the safety element (5) from its lower closed position to its upper open position by activating the upper gripping part (6).

15 Claims, 6 Drawing Sheets

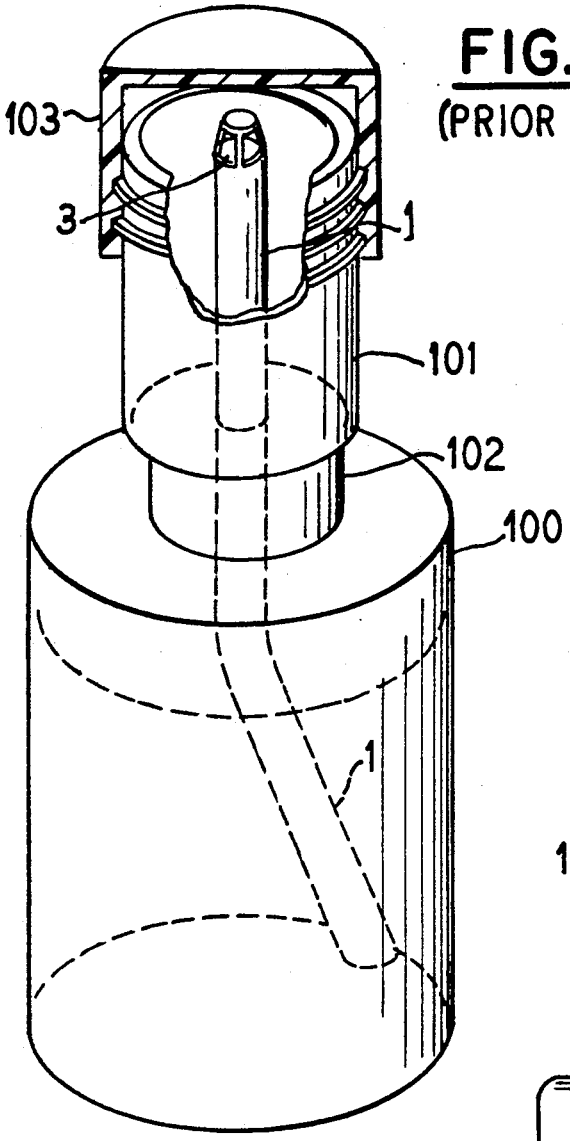
FIG_7
(PRIOR ART)
FIG_8
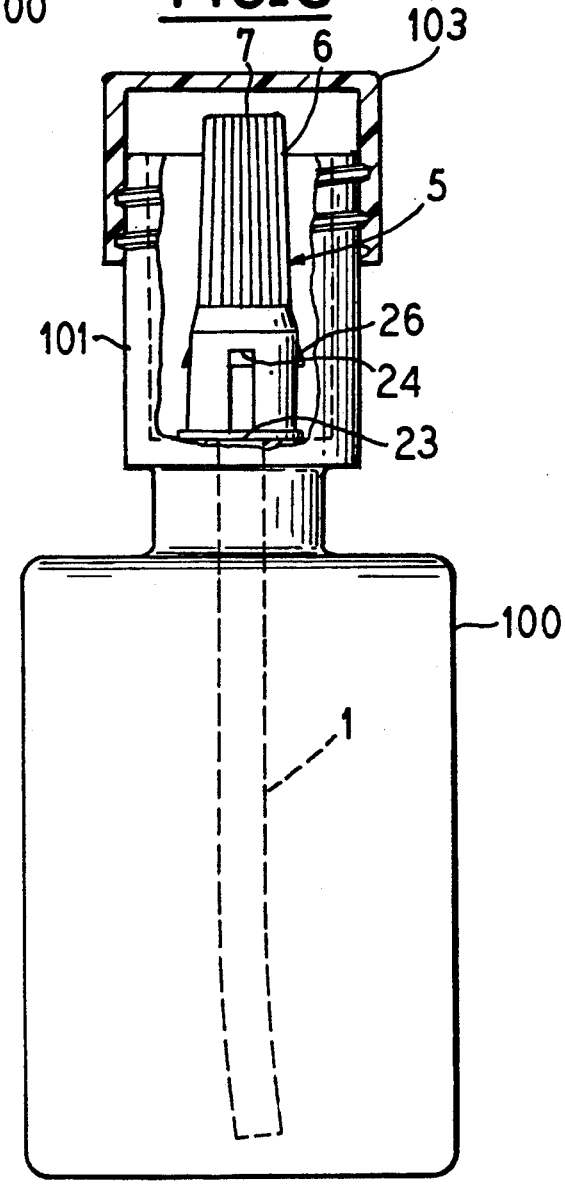

DEVICE FOR DISPENSING MEASURES OF A GIVEN VOLUME OF A LIQUID CONTAINED IN A DEFORMABLE CONTAINER COMPRISING A SAFETY ELEMENT

FIELD OF THE INVENTION

The invention relates to a device for dispensing measures of a given volume of a liquid contained in a deformable container comprising a safety element.

A device (see FIG. 7) for dispensing measures of a given volume of liquid contained in a deformable container 100 of the type comprising, on the one hand, a cup 101 fixed in the neck 102 of the container and in the base of which there is a feed hole for the liquid and, on the other hand, a tube 1 accommodated in an integral manner in the cup, fixed to the base and communicating with the feed hole via its lower end, provided at its upper end with an outlet hole, it being possible for the dispensing device to be protected by a removable cap 103, is already known. FR 2,572,056 discloses an example of this type of device. Although unlikely, there is a risk that, with such a device, once the user has removed the cap he may not realise the device is, in this position, ready for use.

Other alternative embodiments of devices for dispensing measures are known, but they are differently embodied and do not solve the problem posed (see documents U.S. Pat. Nos. 3,123,250, 3,120,910, 3,095,128, 3,252,634).

SUMMARY OF THE INVENTION

The invention therefore aims to solve this safety problem.

To this end, the invention proposes a safety device of the type mentioned above which also comprises a one-piece, displaceable safety element, comprising an upper gripping part having a transverse closing face, a hollow central part forming a valve and a lower part forming a slide and outlet orifice, also hollow, this safety element therefore comprising an axial hollow being mounted so as to slide axially on the tube via its lower part between two limit positions where it may be held, namely, on the one hand, a lower closed position where the central part of the safety element is active and prevents the passage of liquid from the container to the cup via the tube and its feed and outlet holes and, on the other hand, an upper open position where this passage is made possible via axial lateral holes in the lower part and the axial hollow with which they communicate, the central part then being inactive, the upper gripping part of the safety element projecting permanently, at least partially, from the cup, the safety element being such that, once the cap has been removed by the user, the latter must, in order to be able to use the device for dispensing measures, deliberately move the safety element from its lower closed position to its upper open position by activating the upper gripping part.

In addition, devices forming a valve and which are displaceable by axial sliding are already known (see, for example, document FR 2,563,190). However, such devices are not suited for combination with dispensing devices such as those mentioned above.

BRIEF DESCRIPTION OF THE DRAWINGS

The other characteristics of the invention will emerge from the following description with reference to the appended drawings, in which:

FIG. 7 is a perspective view of a prior art container with portions removed for purposes of illustration; and FIG. 8 is a side view with portions broken away of a container with the dispensing device of the present invention.

DESCRIPTION OF THE PREFERRED EMBODIMENT

The invention relates to a device for dispensing measures of a given volume of a liquid contained in a deformable container of the general type described in document FR 2,572,056, to which express reference may be made. For this reason, the general structure of such a device is not described again here in detail, the description being limited solely to the additional safety means.

Figure 1:
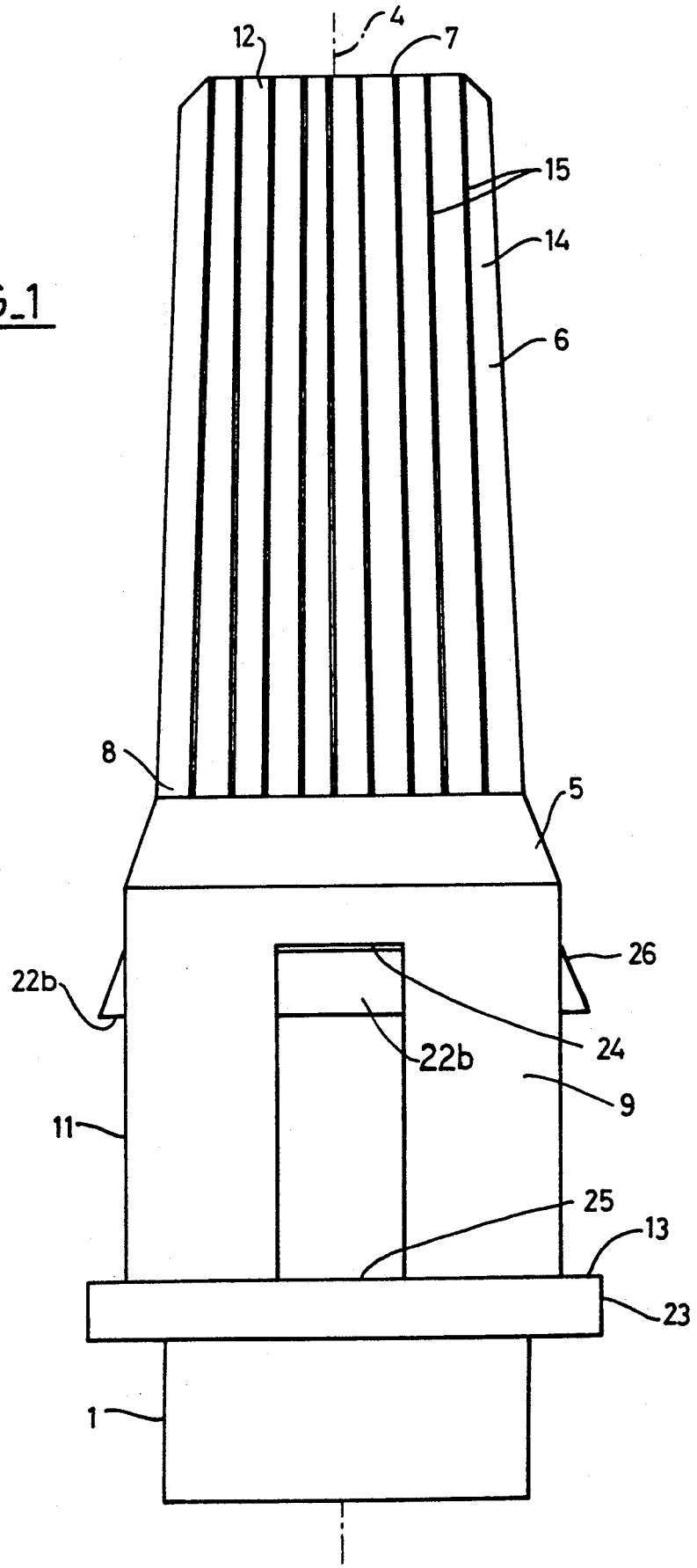
FIGS. 1 and 2 are two external and elevation views of the dispensing device according to the invention, shown only in part (the cup, the container and the cap not being shown), respectively in a lower closed position and in an upper open position.
Figure 2:
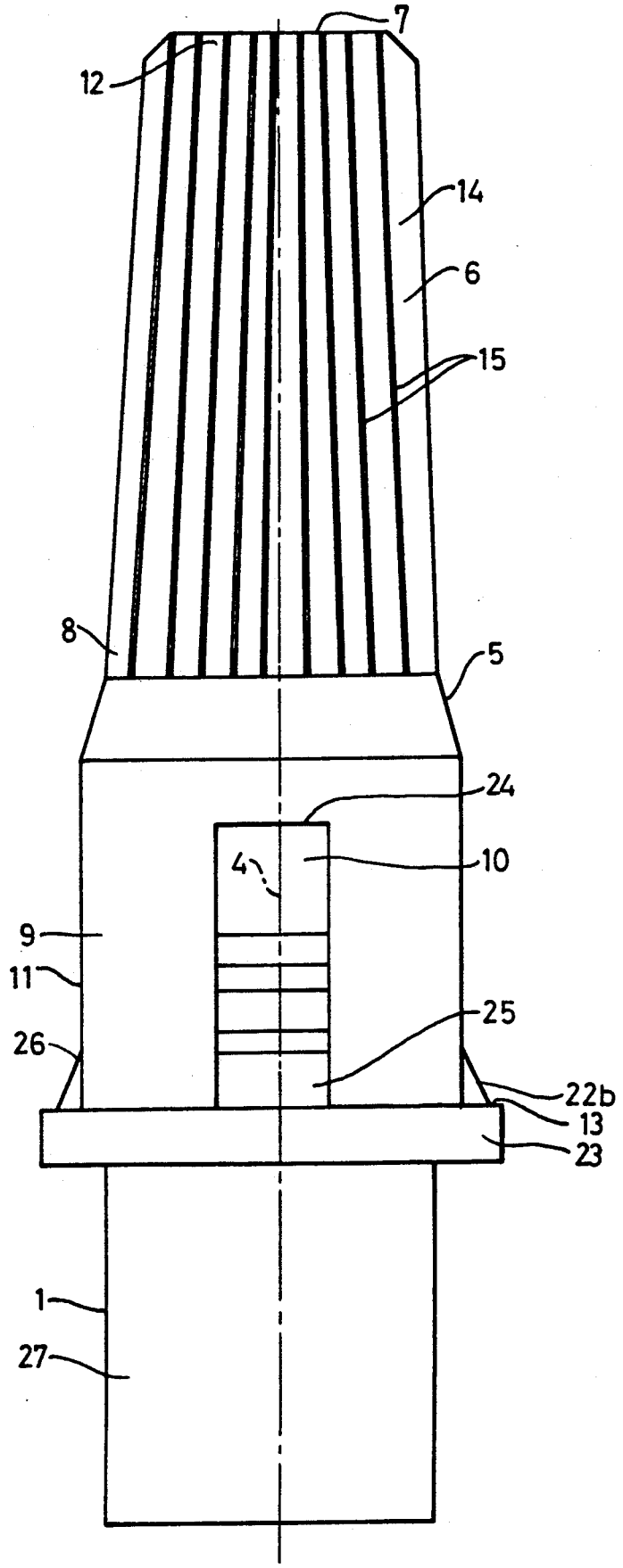
Figure 3:
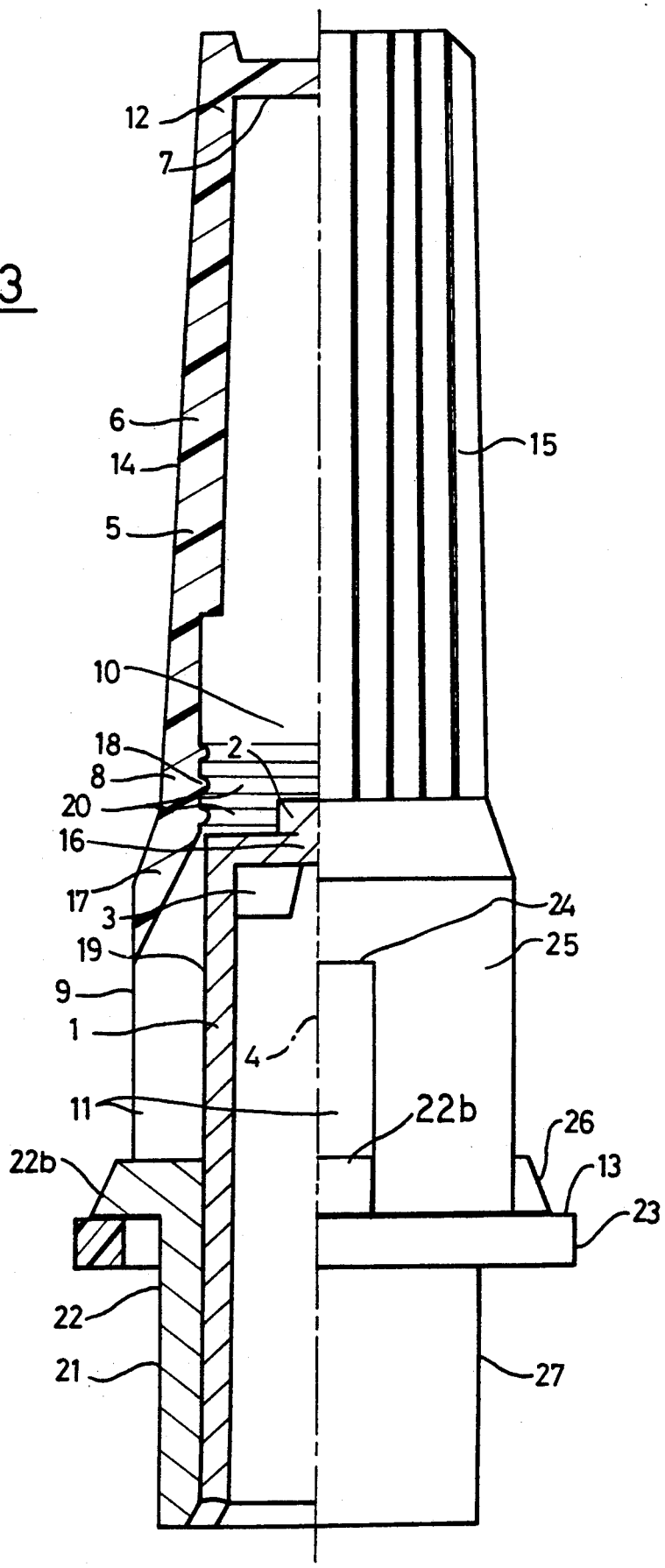
FIG. 3 is also a partial view of a dispensing device according to the invention in an upper open position, on the outside and in elevation (right half-view) and in axial section (left half-view).
Figure 4:
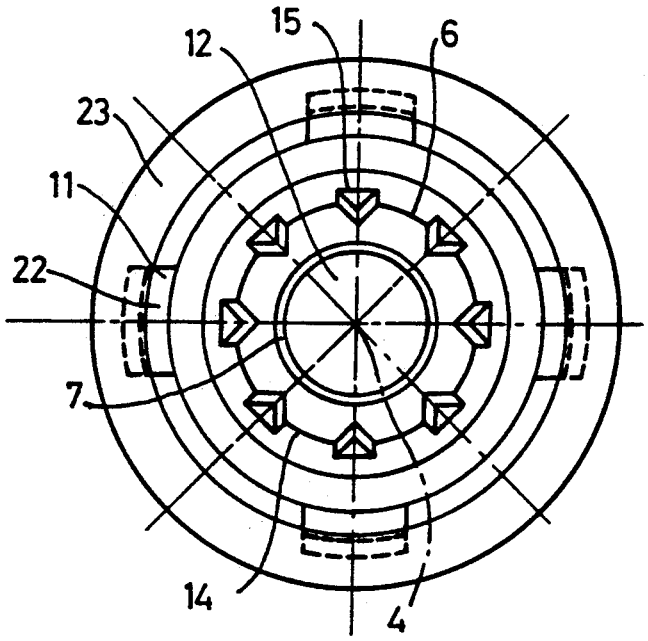
FIG. 4 is an axial view of the device from above.
Figure 5:
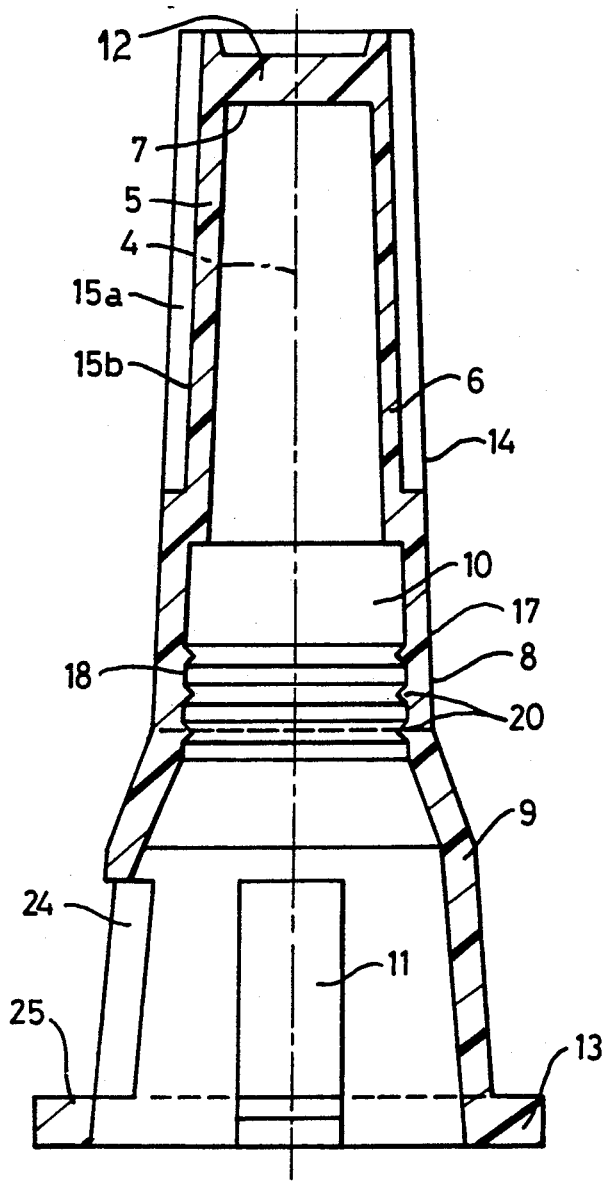
FIGS. 5 and 6 are two views in axial section of the safety element and of the guide sleeve respectively.
Figure 6:
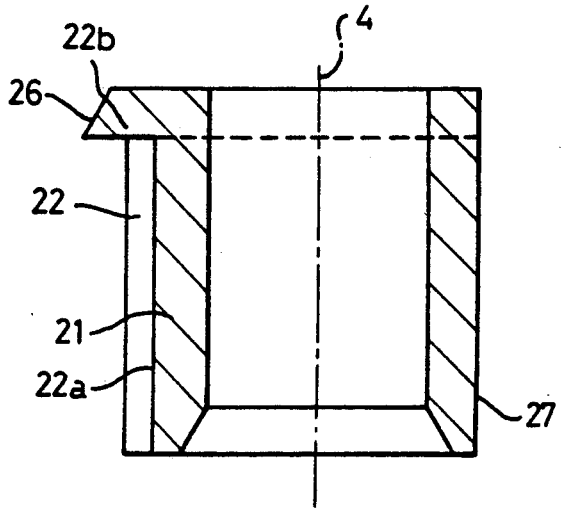

As a reminder, it will therefore be recalled from FIG. 7 that such a dispensing device is of the type comprising, on the one hand, a cup 101 fixed in the neck 102 of the container 100 and in the base of which there is a feed hole for the liquid and, on the other hand, a tube 1 accommodated in and integral manner in the cup, fixed to the base and communicating with the feed hole via its lower end, provided at its upper end 2 with an outlet hole 3, it being possible for the dispensing device to be protected by a removable cap 103. The container 100, the cup 101 with a dispenser having a safety device 5, and the removable cap 103 are shown in FIG. 8 but are not shown in FIGS. 1–6.

Such a dispensing device is intended, for example, for a domestic maintenance liquid (of greater or lesser viscosity). Such a container with its dispensing device is intended to be used with its axis 4 at least substantially vertical, the dispensing device being at the top. The indications which appear in the description relating to the descriptions of "upper", "lower" or equivalent refer to this specific use position. However, the dispensing device and the container may obviously be placed in other positions, particularly a horizontal position, for storage or transportation, for example.

According to the invention, the dispensing device also comprises a one-piece, displaceable safety element 5 comprising an upper gripping part 6 having a transverse closing face 7, a hollow central part forming a valve member or part 8 and a lower part 9 forming a slide and outlet orifice, also hollow, this safety element therefore comprising an axial hollow 10 being mounted so as to slide axially on the tube 1 via its lower part 9 between two limit positions where it may be held, namely, on the one hand, a lower closed position where the central part 8 of the safety element 5 is active and prevents the passage of liquid from the container to the cup via the tube 1 and its feed and outlet holes 3 and, on the other hand, an upper open position where this passage is made possible via axial lateral holes 11 in lower part 9 and the axial hollow 10 with which they communicate, the central part 8 then being inactive, the upper gripping part 6 of the safety element 5 projecting permanently, at least partially, from the cup, the safety element 5 being such that, once the cap has been removed by the user, the latter must, in order to be able to use the device for dispensing measures, deliberately move the safety element 5 from its lower closed position to its upper open position by activating the upper gripping part 6.

The safety element 5 is preferably made from plastic material in a single piece. It has a general outer form which is at least substantially pseudocylindrical, pseudoconical or frustoconical, pseudoprismatic, pseudopyramidal or truncated pyramid or a combination of such general forms. In particular, it has an outer diameter which is greater in the lower part 9 than in the central part 8. To this end, the safety element 5 may have an outer form which continuously enlarges as regards its external diameter, from its free upper end 12 of smaller external diameter to its free lower end 13 of greater external diameter.

The upper gripping part 6 has the general form of a rod, in particular hollow, the transverse closing face 7 being located at its free upper end 12, the outer lateral face 14 of the latter being provided, if appropriate, with engagement reliefs 15 to facilitate gripping. For example, the reliefs 15 are alternate projections 15*a* and hollows 15*b* which extend axially.

In this case, the safety element 5 is totally hollow. The axial hollow 10 has an internal diameter which is greater in the lower part 9 than in the central part 8.

For example and for uses such as for domestic maintenance liquids, the cup may have an axial length of the order of 3.5 cm and a diameter of the order of 3 cm. The tube 1 may have an axial length of the order of 2.5 cm and an external diameter of the order of 0.75 cm. The safety element 5 may have an axial length of the order of 4.5 cm and an external diameter ranging from the order of 0.9 cm at the free upper end 12 to of the order of 1.7 cm at the free lower end 13. Its axial path may be of the order of 0.7 cm. Naturally, these values purely illustrate a particular exemplary embodiment. However, they do not limit the scope of the invention.

In the form shown, the outlet hole 3 is lateral and the tube 1 comprises, at its upper end 2 a free transverse face 16, which means that the jet of liquid coming from the container when it is pressed has a transverse path on exit from the tube 1 (that is to say substantially perpendicular to the axis 4) which is directed towards the inner lateral wall 17 of the hollow 10 (and not axial).

The valve in the central part 8 is constituted by its inner lateral face 18 which, in a lower closed position, interacts sealingly with the tube 1 beyond its outlet hole 3. The face 18 forms part of the wall 17 and constitutes an axial section of the central part 8 thereof. For example, the face 18 is matched dimensionally in order to interact with leakproof friction on a section 19 of the lateral outer face of the tube 1 adjacent to the hole 3 in the opposite direction from the free transverse face 16 (that is to say in the direction of the base of the cup). This section 19 may have a certain axial length such that the seal is increased. In alternative embodiments the face 18 may have a slight conicity with its top directed towards the upper free end 12. Or alternatively, it may have one or more internal peripheral projections 20 having, for example, a certain elasticity in order to match the section 19.

In the upper open position, the tube 1 is essentially separated radially from the wall 17 of the hollow 10. In particular, the face 18 which, in a closed position, acts as a valve is then separated axially from the section 19 and, for example, located at least substantially above the transverse face 16. Opposite the outlet hole 3 in the transverse radial direction in this open position, the wall 17 is transversely and radially separated, which provides the passage for the flow of the liquid. To this end, the axial section of the wall 17 perpendicular, in the transverse radial direction, to the outlet hole 3 may, in an open position, have a conicity whose top is towards the free end 12, thus aiding the passage of the liquid.

In order to ensure the sliding of the safety element 5, the device comprises a guide sleeve 21 located on the outside around and fixed rigidly to the tube 1 in its lower part, this sleeve 21 comprising axial guide reliefs which prevent sliding of the safety element 5 in a lower closed position and upper open position. The sleeve 21 comprises for each hole 11 of the safety element 5 a relief in the form of an axial projection 22*a* on the outside and, at the upper free end of the latter, an outer transverse projection 22*b*, this outer transverse projection 22*b* interacting with the hole 11. The lower part 9 comprises, at the lower free end 13, an outer peripheral rib 23. The outer transverse projections 22*b* of the sleeve 21 are located at least substantially at the upper and lower ends 24, 25 of the hole 11 when the safety element 5 is, respectively, in the lower closed position and the upper open position. The safety element 5 is mounted forcibly on the guide sleeve 21, the transverse projections 22*b* having, to this end, upper edges 26 which are inclined to allow snap-tight assembly. The safety element 5 is mounted with slight friction on the guide sleeve 21. For example, four holes 11 and four reliefs 22 arranged at 90° around the axis 4 are provided. However, provision may be made for a different number of holes 11 and of reliefs 22, provided that the functions of guided sliding and of passage of liquid are fulfilled.

In elevation, a hole 11 has a general narrow rectangular form whose length extends parallel to the axis 4. The hole 11 extends over the lower part 9 between the rib 23 and the connection with the central part 8. In the closed position, the holes 11 are located radially perpendicular to the sleeve 21. In an open position they are located substantially above the sleeve 21 perpendicular to the tube 1.

The sleeve 21 essentially comprises a lateral wall 27, with an axis 4, fixed rigidly to the tube 1, the reliefs 22 extending on said wall 27.

In particular, the axial projections 22*a* extend over all or almost all of the axial height of the sleeve 21. In addition, the transverse projections 22*b* are located at the site of or close to the upper edge of the sleeve 21.

According to another characteristic, the relative dimensions in the axial direction are such that, when the cap is placed over the neck of the container, in its closed state, it interferes with the safety element 5 unless the element 5 is in a lower closed position. In particular, the transverse face of the cap engages the upper free end 12.

Therefore, as results from the above, the holes 11, in combination with the reliefs 22, help to guide the safety element 5 in its axial sliding movement. In addition, they permit the discharge of the liquid when the safety element 5 is in an open position.

I claim:

1. A device for dispensing measures of a given volume of a liquid contained in a deformable container of the type comprising a cup fixed in a neck of the container and having a base of which there is a feed hole for the liquid and a tube accommodated in an integral manner in the cup being fixed to the base and communicating with the feed hole via its lower end and being provided at its upper end with an outlet hole, the dispensing device being protected by a removable cap, said device including a one-piece, axially hollow, displaceable safety element comprising an upper gripping part having a transverse closing face, a hollow central part forming a valve member, and a hollow lower part forming a slide and outlet orifice, said safety element being mounted so as to slide axially on the tube via its lower part between a limited lower position and a limited upper position, said lower position having the central part closing said outlet holes to prevent passage of liquid from the container through the tube to the cup, said upper position having the central part opening said outlet hole to allow flow between the container via the tube, and the upper gripping part of the safety element projecting partially from the cup so that once the cap is removed by the user, the user, in order to use the device for dispensing measures, must deliberately move the safety element from the lower position to the upper position to permit flow from the container through the outlet hole into the cup.

2. A device according to claim 1, wherein the relative dimensions of the safety element in the axial direction are such that, when the cap is placed over the neck of the container in its closed state, the cap will interfere with the safety element until the safety element is moved to the lower position.

3. A device according to claim 1, wherein the safety element has a general outer form having at least one portion selected from a group of shapes comprising substantially pseudocylindrical, pseudoconical, frustoconical, pseudoprismatic, pseudopyramidal, and truncated pyramid.

4. A device according to claim 3, wherein the safety element has at least a combination of two portions with each portion being selected from said group.

5. A device according to claim 3, wherein the upper gripping part has the general form of a hollow rod, the transverse closing face being located at the free upper end thereof, the outer lateral face of the upper gripping part being provided with engagement reliefs to aid gripping.

6. A device according to claim 1, wherein the valve member of the central part is constituted by its inner lateral face which, in a lower closed position, sealingly interacts with the outlet hole of the tube.

7. A device according to claim 1, wherein the hollow lower part has an internal diameter which is greater than the internal diameter of the central part.

8. A device according to claim 1, wherein the lower part at a lower free end has an outer peripheral rib.

9. A device according to claim 1, wherein the safety element has an external diameter which is greater in the lower part than in the central part.

10. A device according to claim 1, wherein the safety element is made from plastic material in a single piece.

11. A device according to claim 1, which includes a guide sleeve located on the outside of the tube and being fixed rigidly to the tube, said sleeve comprising axial guide reliefs which limit sliding of the safety element between the lower closed position and the upper open position.

12. A device according to claim 11, wherein the lower part of the safety element has at least one hole, said sleeve for each hole of the safety element has a relief in the form of an axial projection on the outside and at the upper free end of the latter an outer transverse projection interacting with the hole.

13. A device according to claim 12, wherein the outer transverse projections of the sleeve are located at least substantially at the upper and lower ends of the holes when the safety element is, respectively, in the lower closed position and the upper open position.

14. A device according to claim 12, wherein the safety element is mounted forcibly on the guide sleeve, the transverse projections having upper edges which are inclined to allow a snap-tight assembly.

15. A device according to claim 11, wherein the safety element is mounted with a slight friction on the guide sleeve.

* * * * *